US011845288B2

(12) United States Patent
Kawakami

(10) Patent No.: US 11,845,288 B2
(45) Date of Patent: Dec. 19, 2023

(54) FLOW PATH UNIT AND LIQUID EJECTING DEVICE

(71) Applicant: SEIKO EPSON CORPORATION, Tokyo (JP)

(72) Inventor: Ryo Kawakami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/651,145

(22) Filed: Feb. 15, 2022

(65) Prior Publication Data

US 2022/0258482 A1 Aug. 18, 2022

(30) Foreign Application Priority Data

Feb. 16, 2021 (JP) ..... 2021-022327

(51) Int. Cl.
*B41J 2/175* (2006.01)

(52) U.S. Cl.
CPC ..... *B41J 2/17563* (2013.01); *B41J 2/175* (2013.01)

(58) Field of Classification Search
CPC ..... B41J 2/17563; B41J 2/175
See application file for complete search history.

(56) References Cited

U.S. PATENT DOCUMENTS

2016/0167390 A1 6/2016 Nakagawa et al.
2020/0198360 A1 6/2020 Murayama

FOREIGN PATENT DOCUMENTS

JP 61-121955 * 6/1986 ..... B41J 2/175
JP 2019-051724 A 4/2019
JP 2020-100051 A 7/2020

* cited by examiner

*Primary Examiner* — Geoffrey S Mruk
(74) *Attorney, Agent, or Firm* — WORKMAN NYDEGGER

(57) ABSTRACT

Provided is a flow path unit through which liquid to be supplied to a head for ejecting the liquid flows. The flow path unit includes a flow path member having a flow path, and a filter unit configured to be detachably attached to the flow path member, the flow path member has an opening that communicates with the flow path and to which the filter unit is configured to be mounted, and the filter unit includes a filter configured to filter liquid flowing through the flow path, and a holding member configured to hold the filter.

5 Claims, 8 Drawing Sheets

FLOW PATH UNIT AND LIQUID EJECTING DEVICE

The present application is based on, and claims priority from JP Application Serial Number 2021-022327, filed Feb. 16, 2021, the disclosure of which is hereby incorporated by reference herein in its entirety.

BACKGROUND

1. Technical Field

The present disclosure relates to a flow path unit and a liquid ejecting device.

2. Related Art

JP-A-2020-100051 discloses, as an example of a liquid ejecting device, a liquid jetting device that includes a filter unit through which liquid to be supplied to a head for ejecting the liquid flows. The filter unit is an example of a flow path unit. The filter unit has a filter configured to filter the liquid. The filter unit supplies liquid filtered by the filter to the head.

In such a flow path unit, the filter is deteriorated along with the use of the filter. As a result, it is necessary to exchange the filter. In the liquid ejecting device disclosed in JP-A-2020-100051, it is necessary to exchange an entire flow path unit in order to exchange a filter. Accordingly, there is room for improvement in the ease of use of the flow path unit.

SUMMARY

According to an aspect of the present disclosure, there is provided a flow path unit through which liquid to be supplied to a head for ejecting the liquid flows, wherein the flow path unit includes a flow path member having a flow path, and a filter unit configured to be detachably attached to the flow path member, the flow path member has an opening that communicates with the flow path and to which the filter unit is configured to be mounted, and the filter unit includes a filter configured to filter liquid flowing through the flow path, and a holding member configured to hold the filter.

According to another aspect of the present disclosure, there is provided a liquid ejecting device that includes a head configured to eject liquid, and a flow path unit through which liquid to be supplied to the head flows, wherein the flow path unit includes a flow path member having a flow path, and a filter unit configured to be detachably attached to the flow path member, the flow path member has an opening that communicates with the flow path and to which the filter unit is configured to be mounted, and the filter unit includes a filter configured to filter liquid flowing through the flow path, and a holding member configured to hold the filter.

DESCRIPTION OF EXEMPLARY EMBODIMENTS

Hereinafter, a liquid ejecting device including a flow path unit according to an embodiment is described with reference to drawings. For example, the liquid ejecting device is an ink jet-type printer configured to record an image such as characters and photographs on a medium such as a sheet or a fabric by ejecting ink that is an example of liquid.

Figure 1:
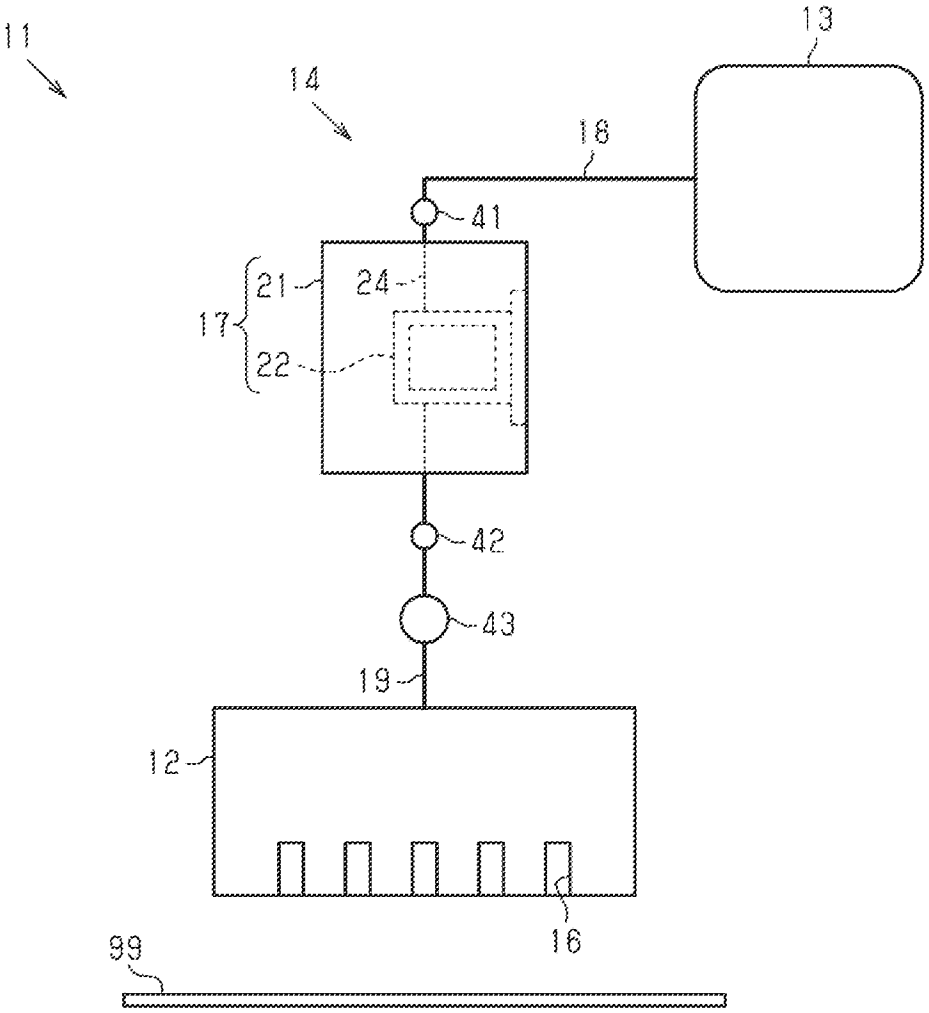
FIG. 1 is a schematic view illustrating a liquid ejecting device including a flow path unit according to an embodiment.
Figure 2:
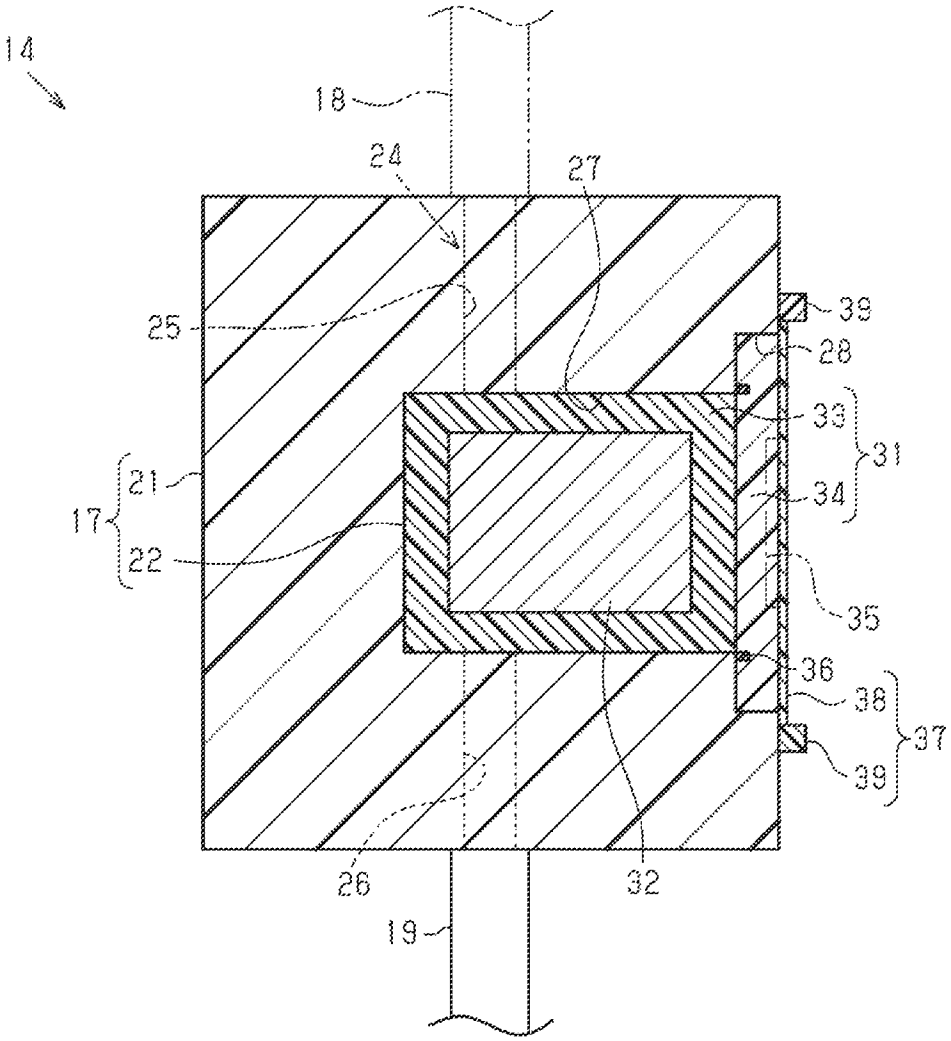
FIG. 2 is a cross-sectional view of the flow path unit.
Figure 3:
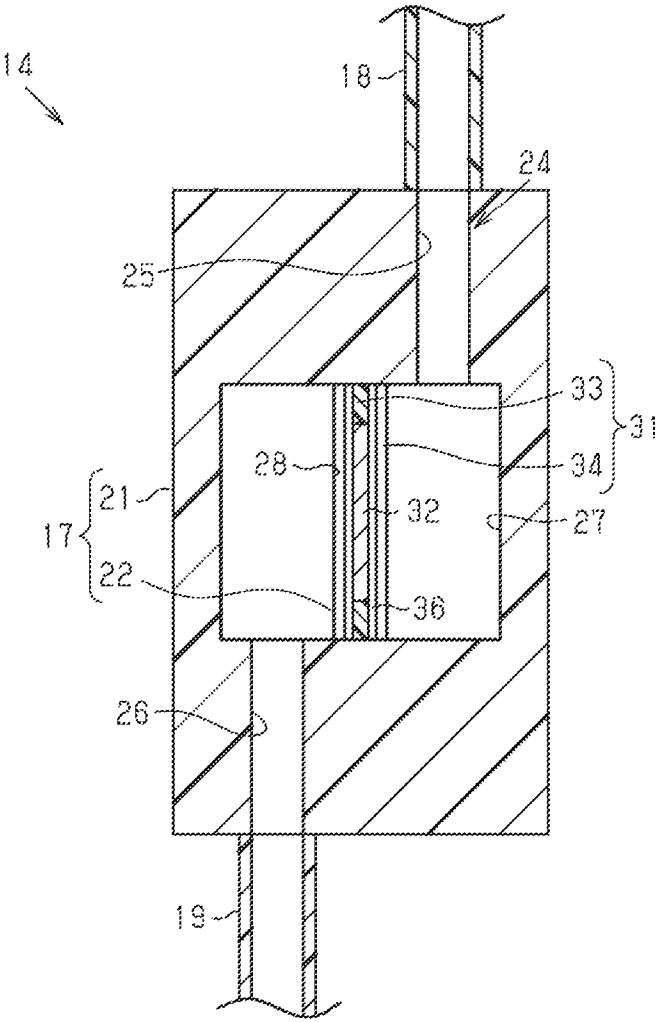
FIG. 3 is a cross-sectional view of the flow path unit taken at a position different from that of FIG. 2.
Figure 4:
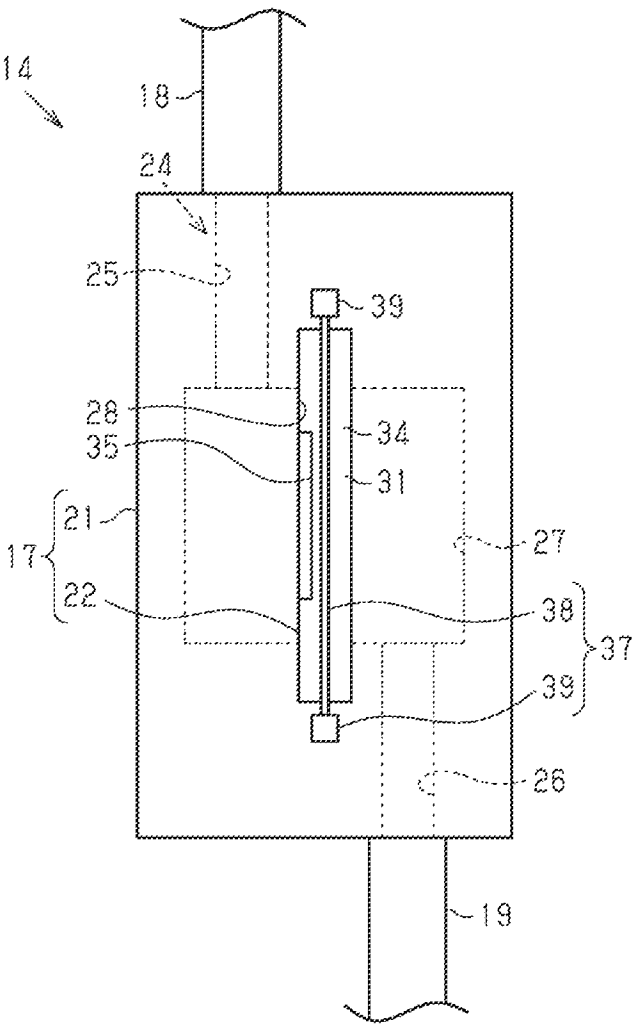
FIG. 4 is a front view of the flow path unit when an opening is viewed in front view.
Figure 5:
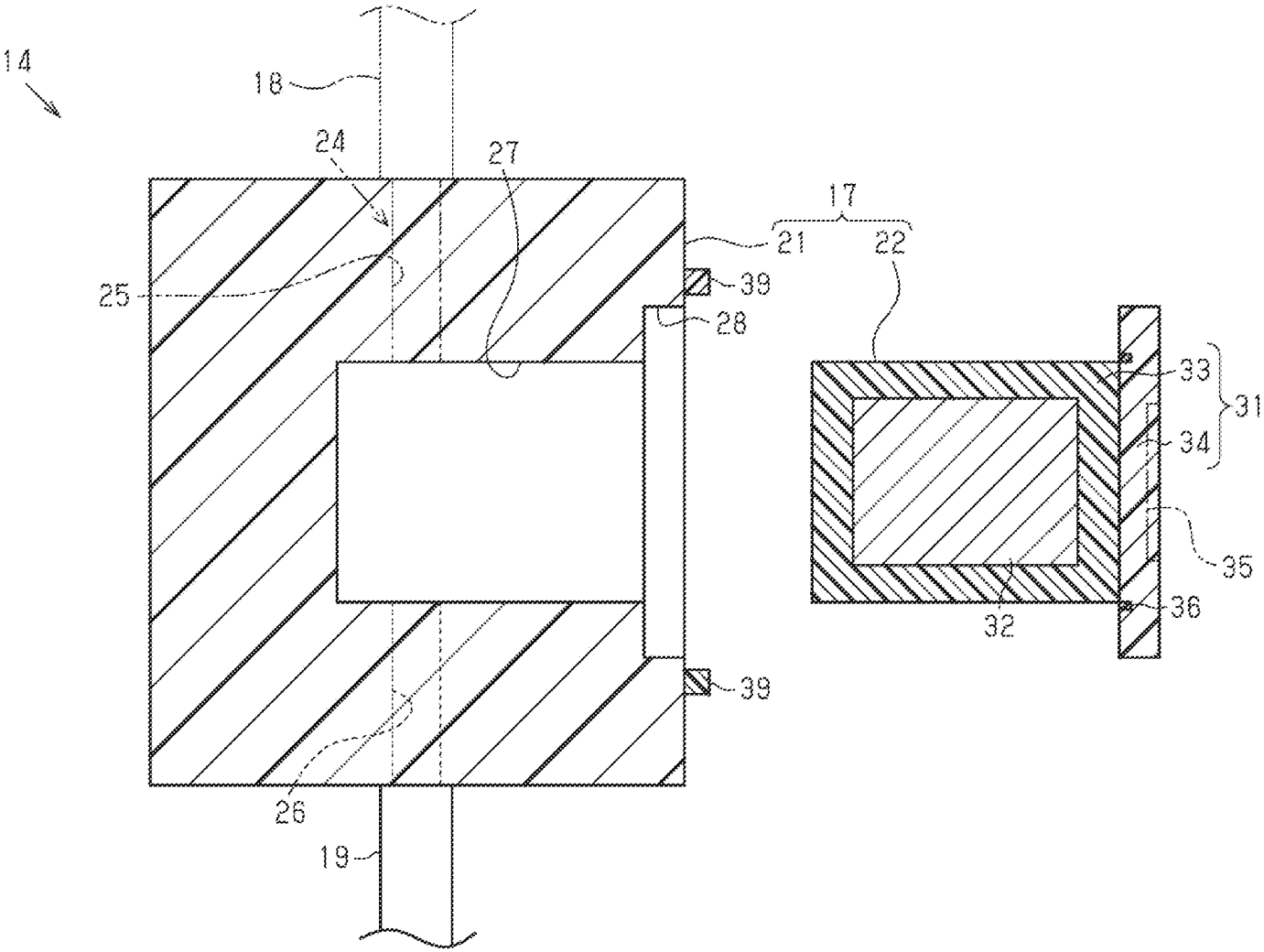
FIG. 5 is a cross-sectional view of the flow path unit in a state where a filter unit is removed from the flow path unit in a state illustrated in FIG. 2.

As illustrated in FIG. 1, a liquid ejecting device 11 includes a head 12, a storage unit 13, and a supply flow path 14.

The head 12 is configured to eject liquid. The head 12 includes one or a plurality of nozzles 16. The head 12 is configured to record an image on a medium 99 by ejecting liquid from the nozzles 16 toward the medium 99.

The storage unit 13 is configured to store liquid to be supplied to the head 12. For example, the storage unit 13 is an ink tank or an ink cartridge.

The supply flow path 14 is coupled to the head 12 and the storage unit 13. Liquid flows from the storage unit 13 toward the head 12 through the supply flow path 14.

The supply flow path 14 includes a flow path unit 17. That is, the liquid ejecting device 11 includes the flow path unit 17. The supply flow path 14 includes a first supply flow path 18 and a second supply flow path 19 in addition to the flow path unit 17. The first supply flow path 18 is coupled to the storage unit 13 and the flow path unit 17. The second supply flow path 19 is coupled to the flow path unit 17 and the head 12.

In the present embodiment, the flow path unit 17 is indirectly coupled to the storage unit 13 through the first supply flow path 18. In the present embodiment, the flow path unit 17 is indirectly coupled to the head 12 through the second supply flow path 19. The flow path unit 17 may be directly coupled to the storage unit 13 or may be directly coupled to the head 12. In the supply flow path 14, a position at which the flow path unit 17 is disposed is not limited.

As illustrated in FIG. 2, FIG. 3, FIG. 4, and FIG. 5, the flow path unit 17 includes a flow path member 21 and a filter unit 22 mounted in the flow path member 21. The flow path unit 17 is a unit through which liquid supplied from the storage unit 13 to the head 12 flows.

The flow path member 21 has a flow path 24. For example, the flow path 24 is coupled to the first supply flow path 18 and the second supply flow path 19. The flow path 24 includes a first flow path 25, a second flow path 26, and a filtration flow path 27.

For example, the first flow path 25 is coupled to the first supply flow path 18. For example, the second flow path 26 is coupled to the second supply flow path 19. The filtration flow path 27 is coupled to the first flow path 25 and the second flow path 26. Accordingly, liquid flowing through the flow path 24 flows the first flow path 25, the filtration flow path 27, and the second flow path 26 in this order. The filtration flow path 27 also functions as a space for accommodating the filter unit 22 mounted in the flow path member 21. Accordingly, liquid flowing through the flow path 24 passes through the filter unit 22.

An opening 28 is formed in the flow path member 21. The opening 28 causes the inside of the flow path member 21 to communicate with the outside of the flow path member 21. The opening 28 communicates with the flow path 24. Specifically, the opening 28 communicates with the filtration flow path 27.

The filter unit 22 is mounted in the opening 28. Accordingly, the filter unit 22 passes through the opening 28 when the filter unit 22 is mounted in the flow path member 21 or when the filter unit 22 is dismounted from the flow path member 21. The opening 28 and the filtration flow path 27 function as a mounting portion in which the filter unit 22 is mounted. The filter unit 22 is mounted in the flow path member 21 by being inserted into the opening 28 and the filtration flow path 27.

The filter unit 22 is configured to be detachably attached to the flow path member 21, that is, is mounted in the flow path member 21 in an exchangeable manner. The filter unit 22 includes a holding member 31 and a filter 32. The holding member 31 is configured to hold the filter 32. For example, the holding member 31 has a holding portion 33 and a handle portion 34. The holding portion 33 is a portion that is brought into contact with the filter 32. In a state where the filter unit 22 is mounted in the flow path member 21, the holding portion 33 is positioned at the filtration flow path 27. The holding portion 33 extends from the handle portion 34. The handle portion 34 is a portion that is gripped when the filter unit 22 is mounted in the flow path member 21 or when the filter unit dismounted from the flow path member 21. In the present embodiment, the handle portion 34 has a cutout 35. When a user hooks his/her nail on the cutout 35, the filter unit 22 can be easily removed from the flow path member 21.

For example, the filter 32 is a metal mesh filter. In a state where the filter unit 22 is mounted in the flow path member 21, the filter 32 is positioned in the filtration flow path 27. In a state where the filter unit 22 is mounted in the flow path member 21, the holding portion 33 and the filter 32 are positioned so as to close the filtration flow path 27. Accordingly, liquid flowing through the filtration flow path 27 passes through the filter 32. With such a configuration, foreign materials are removed from the liquid. In this manner, the filter 32 filters the liquid flowing through the flow path 24.

In the present embodiment, the filter 32 is welded to the holding member 31. Accordingly, in the present embodiment, the filter 32 is exchanged by exchanging the filter unit 22. The filter 32 may be configured to be detachably attached to the holding member 31. In this case, the filter 32 can be exchanged independently from the holding member 31. For example, when the filter unit 22 is removed, the holding member 31 can be reused by exchanging the filter 32.

The flow path unit 17 may include an elastic member 36 having elasticity. For example, the elastic member 36 is made of rubber, elastomer, or the like. The elastic member 36 is positioned between the flow path member 21 and the filter unit 22. In a state where the filter unit 22 is mounted in the flow path member 21, the elastic member 36 is elastically deformed by being sandwiched between the filter unit 22 and the flow path member 21. For example, the elastic member 36 is sandwiched between the flow path member 21 and the handle portion 34. With such a configuration, the elastic member 36 seals a gap between the flow path member 21 and the filter unit 22. Accordingly, in a state where the filter unit 22 is mounted in the flow path member 21, a possibility that liquid flowing through the flow path 24 leaks out from the opening 28 is reduced.

The elastic member 36 may be configured to be removable from the flow path member 21. In the present embodiment, the elastic member 36 is fixed to the filter unit 22. Accordingly, the elastic member 36 is removed from the flow path member 21 by removing the filter unit 22 from the flow path member 21. In the present embodiment, the elastic member 36 is exchanged along with the exchange of the filter unit 22. For example, the elastic member 36 is formed in an annular shape, and is disposed so as to surround a proximal end of the holding portion 33. The proximal end of the holding portion 33 is an end portion of the holding portion 33 that is coupled to the handle portion 34.

The elastic member 36 may be configured to be removably attached to the filter unit 22. In this case, the elastic member 36 can be exchanged independently from the filter unit 22. The elastic member 36 may be configured to be detachably attached to the flow path member 21 rather than on the filter unit 22. Also in this case, the elastic member 36 can be exchanged independently from the flow path member 21.

The flow path unit 17 may include a stopper 37 for retaining the filter unit 22 mounted in the flow path member 21. With the provision of the stopper 37, a possibility that the filter unit 22 is unexpectedly removed from the flow path member 21 can be reduced. In the present embodiment, due to the elasticity of the elastic member 36, a force is applied to the filter unit 22 in a direction that the filter unit 22 falls from the flow path member 21. Accordingly, the stopper 37 exhibits a large effect in retaining the filter unit 22.

The stopper 37 includes a pin 38 and pin stoppers 39. For example, the pin 38 retains the filter unit 22 by coming into contact with the handle portion 34. The pin stoppers 39 are portions to which the pin 38 is attached. By attaching the pin 38 to the pin stoppers 39, the pin 38 retains the filter unit 22. The pin stoppers 39 are mounted on the flow path member 21. In the present embodiment, two pin stoppers 39 are provided. Two pin stoppers 39 are positioned so as to sandwich the opening 28 when the opening 28 is viewed in front view, for example. The stopper 37 functions by attaching one pin 38 to two pin stoppers 39.

In exchanging the filter unit 22, when liquid remains in the flow path 23, there is a concern that liquid leaks out from the opening 28. Accordingly, in exchanging the filter unit 22, liquid may be discharged from the flow path 24. For example, liquid may be discharged from the flow path 24 by discharging liquid from the nozzles 16. By exchanging the filter unit 22 in a state where the flow path 24 is empty, a concern that liquid leaks out from the opening 28 is reduced.

As illustrated in FIG. 1, the liquid ejecting device 11 may include a valve configured to open and close the supply flow path 14. In the present embodiment, the liquid ejecting device 11 includes, as such a valve, a first valve 41 and a second valve 42, for example. The first valve 41 is positioned in the first supply flow path 18, for example. The second valve 42 is positioned in the second supply flow path 19, for example.

The liquid ejecting device 11 may include a pump 43. The pump 43 is positioned in the second supply flow path 19, for example. In this case, the pump 43 is disposed between the second valve 42 and the head 12. The pump 43 is configured to feed liquid from the storage unit 13 toward the head 12. For example, the pump 43 may be a tube pump, a syringe pump, or a diaphragm pump.

In the present embodiment, for example, when the pump 43 is driven in a state where the first valve 41 and the second valve 42 are opened, liquid is fed from the storage unit 13 to the head 12. For example, when the pump 43 is driven in a state where the first valve 41 is closed and the second valve 42 is opened, liquid is fed from the flow path unit 17 to the head 12. With such a configuration, the flow path unit 17 can be emptied. For example, the filter unit 22 is exchanged in a state where the flow path unit 17 is empty and the first valve 41 and the second valve 42 are closed. As a result, a possibility that liquid leaks out from the opening 28 during a period in which the filter unit 22 is exchanged is reduced.

Next, the manner of operations and advantageous effects of the above-mentioned embodiment are described.

(1) The flow path member 21 has the opening 28 that communicates with the flow path 24 and through which the filter unit 22 is mounted in the flow path member 21.

According to the configuration described above, the filter can be exchanged with a new filter 32 by removing the filter unit 22 from the flow path unit 17 through the opening 28. That is, in exchanging the filter 32, the ease of use of the flow path unit 17 is improved compared to a case where the entire flow path unit 17 is exchanged.

(2) The flow path unit 17 includes the elastic member 36 having elasticity between the flow path member 21 and the filter unit 22.

According to the configuration described above, the possibility that liquid leaks out from the flow path 24 through the opening 28 can be reduced by the elastic member 36.

(3) The elastic member 36 is configured to be removable from the flow path member 21.

According to the configuration described above, the elastic member 36 can be exchanged.

(4) The elastic member 36 is fixed to the filter unit 22.

According to the configuration described above, the elastic member 36 can be exchanged along with the exchange of the filter unit 22.

(5) The flow path unit 17 includes the stopper 37 configured to retain the filter unit 22 mounted in the flow path member 21.

According to the configuration described above, it is possible to suppress the unexpected removal of the filter unit 22 from the flow path member 21.

The present embodiment described above may be modified as follows. The present embodiment and modifications thereof to be described below may be implemented in combination within a range in which a technical contradiction does not arise.

Figure 6:
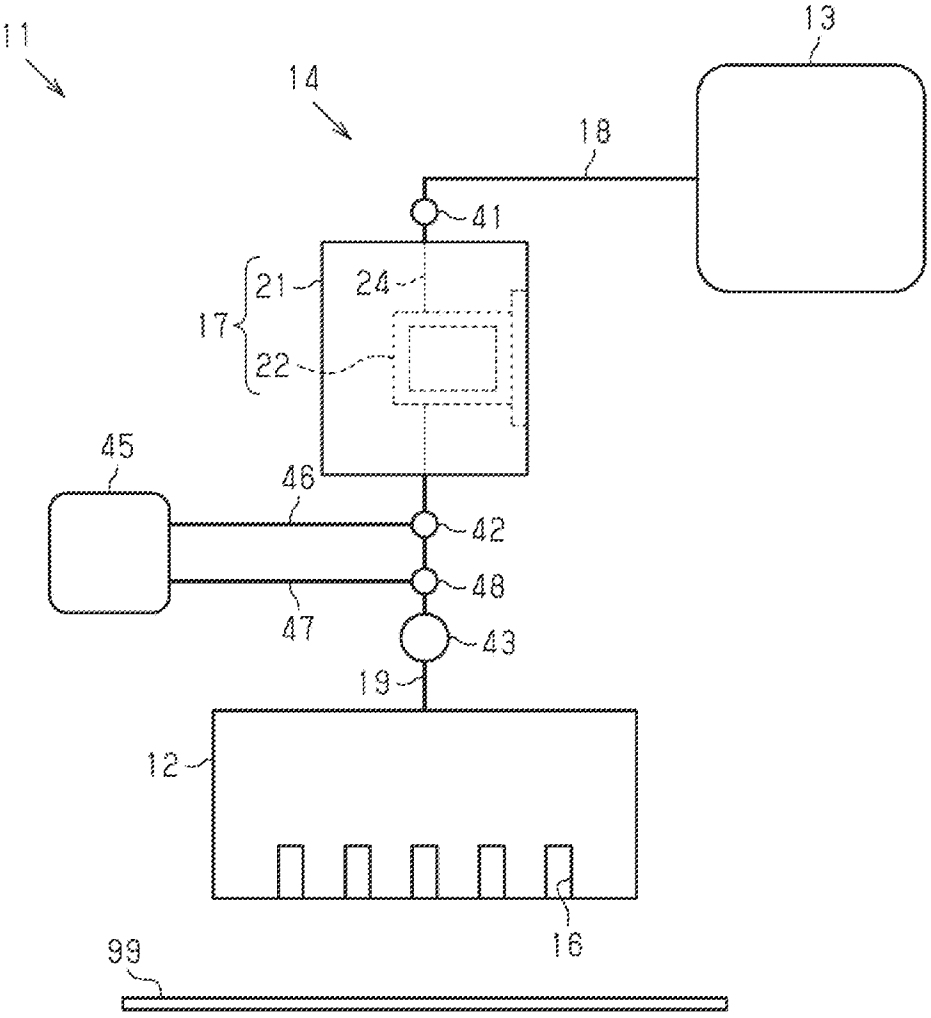
FIG. 6 is a schematic view of a modification of the liquid ejecting device.

As illustrated in FIG. 6, the liquid ejecting device 11 may include a sub storage unit 45, a first sub flow path 46, and a second sub flow path 47. The sub storage unit 45 is configured to store liquid that has passed though the flow path unit 17. The first sub flow path 46 is coupled to the sub storage unit 45 and the second supply flow path 19. The second sub flow path 47 is coupled to the sub storage unit 45 and the second supply flow path 19. Liquid flows from the flow path unit 17 to the sub storage unit 45 through the first sub flow path 46. Liquid flows from the sub storage unit 45 to the head 12 through the second sub flow path 47.

For example, the liquid ejecting device 11 includes, as valves, a third valve 48 in addition to the first valve 41 and the second valve 42. The second valve 42 is, for example, positioned at a coupling portion between the first sub flow path 46 and the second supply flow path 19. The third valve 48 is, for example, positioned at a coupling portion between the second sub flow path 47 and the second supply flow path 19.

The second valve 42 and the third valve 48 are each formed of a three-way valve, for example. The second valve 42 is configured to cause the flow path unit 17 and the sub storage unit 45 to communicate with each other and to interrupt the communication between the flow path unit 17 and the sub storage unit 45. The third valve 48 is configured to cause the sub storage unit 45 and the head 12 to communicate with each other or to interrupt the communication between the sub storage unit 45 and the head 12. In this modification, as the paths through which liquid flows from the flow path unit 17 toward the head 12, there exist a path where liquid flows through the sub storage unit 45 and a path where liquid does not flow through the sub storage unit 45. That is, the second valve 42 and the third valve 48 are configured to open or close the path where liquid flows through the sub storage unit 45.

In a normal case, liquid is supplied from the flow path unit 17 toward the head 12 without flowing through the sub storage unit 45. When the filter unit 22 is exchanged, liquid is supplied from the flow path unit 17 to the sub storage unit 45 in order to empty the flow path unit 17. For example, by driving the pump 43 in a state where the first valve 41 is closed and the path where liquid flows through the sub storage unit 45 is opened, liquid is discharged from the flow path unit 17. When the flow path unit 17 becomes empty, the filter unit 22 is exchanged in a state where the first valve 41 and the second valve 42 are closed. Liquid stored in the sub storage unit 45 is supplied to the head 12 through the second sub flow path 47. That is, when the filter unit 22 is exchanged, liquid is supplied from the flow path unit 17 toward the head 12 through the sub storage unit 45. According to this modification, liquid discharged from the flow path unit 17 in order to exchange the filter unit 22 can be used for recording on the medium 99.

Figure 7:
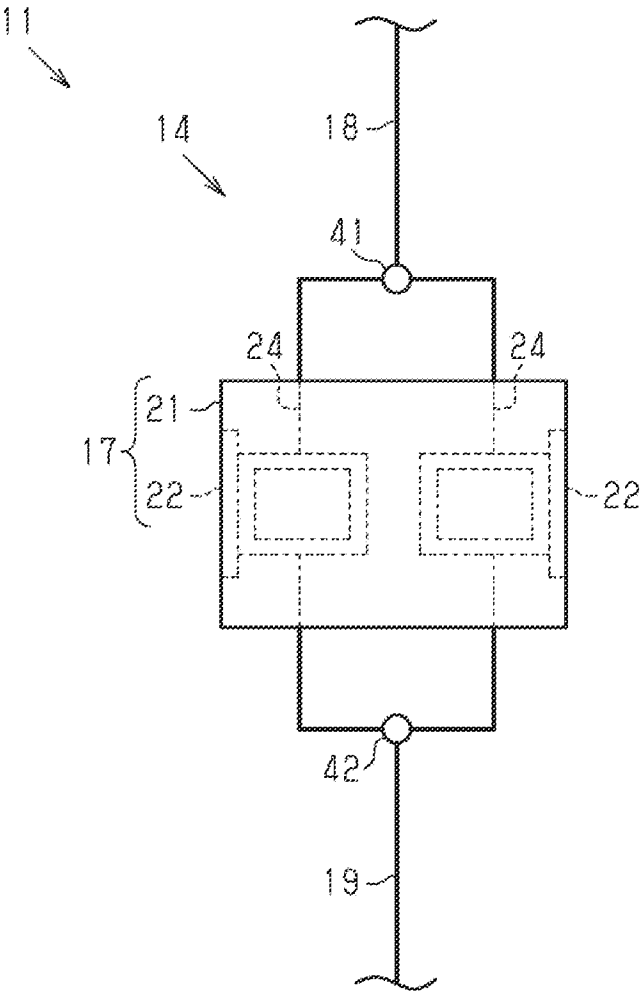
FIG. 7 is a schematic view of a modification of the flow path unit.

As illustrated in FIG. 7, the flow path unit 17 may include a plurality of filter units 22. In this case, the flow path unit 17 includes a plurality of flow paths 24 corresponding to the plurality of filter units 22. The first supply flow path 18 is branched into a plurality of branched portions, and the branched portions are coupled to the plurality of flow paths 24. The second supply flow path 19 is branched into a plurality of branched portions, and the branched portions are coupled to the plurality of flow paths 24.

The first valve 41 is, for example, positioned at a branching portion of the first supply flow path 18. The second valve 42 is, for example, positioned at a branching portion of the second supply flow path 19. The first valve 41 and the second valve 42 are each formed of a three-way valve, for example. Out of the plurality of flow paths 24, one flow path 24 through which liquid flows is decided depending on the state of the first valve 41 and the state of the second valve 42.

According to this modification, during a period in which one filter unit 22 is exchanged, liquid can be supplied to the head 12 through another filter unit 22. Accordingly, a possibility of the occurrence of downtime due to the exchange of the filter unit 22 can be reduced. Here, the downtime is a time during which the liquid ejecting device 11 cannot perform recording on the medium 99, for example.

The liquid ejecting device 11 may include a plurality of flow path units 17. For example, in the modification illustrated in FIG. 7, the plurality of flow path units 17 each having one filter unit 22 may be provided in place of providing one flow path unit 17 having a plurality of filter units 22. In this case, liquid can be supplied to the head 12 through other filter units 22 during a period in which one filter unit 22 is exchanged. Accordingly, a possibility of the occurrence of downtime can be reduced.

Figure 8:
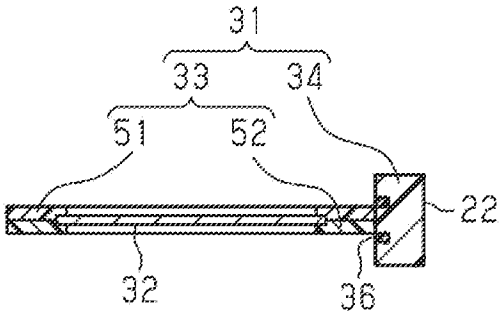
FIG. 8 is a cross-sectional view illustrating a modification of the filter unit.

As illustrated in FIG. 8, the filter 32 may be configured to be removably attached to the filter unit 22. The holding portion 33 has, for example, a first holding portion 51 and a second holding portion 52. The holding portion 33 is configured by assembling the first holding portion 51 and the second holding portion 52 to each other. The filter 32 is held in the holding portion 33 by being sandwiched between the first holding portion 51 and the second holding portion 52. Accordingly, the filter 32 can be removed from the holding portion 33 by disassembling the first holding portion 51 and the second holding portion 52 from each other. In this case, the filter 32 can be exchanged independently from the holding portion 33.

Figure 9:
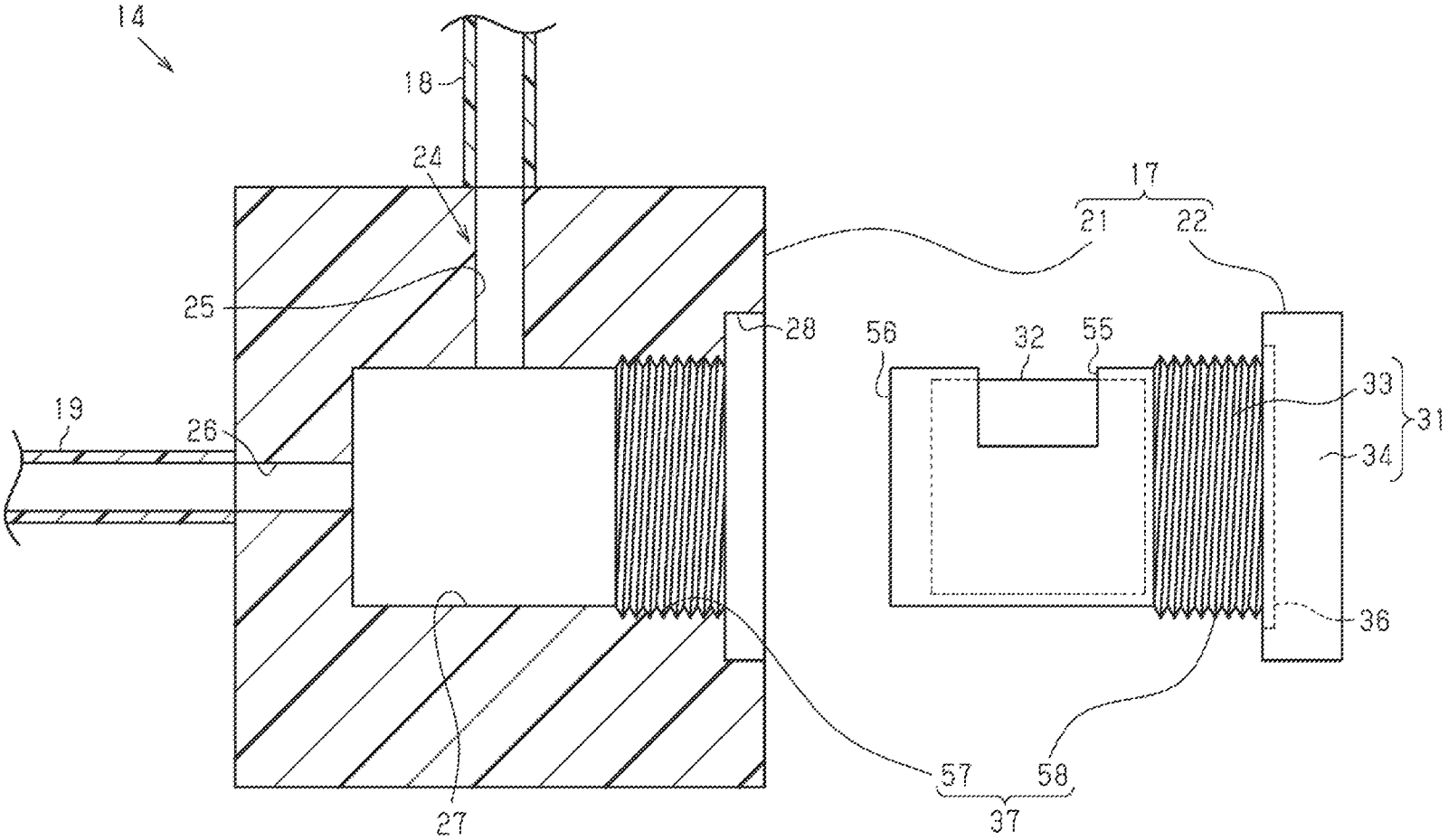
FIG. 9 is a cross-sectional view of another modification of the flow path unit different from the modification of the flow path unit illustrated in FIG. 7.
Figure 10:
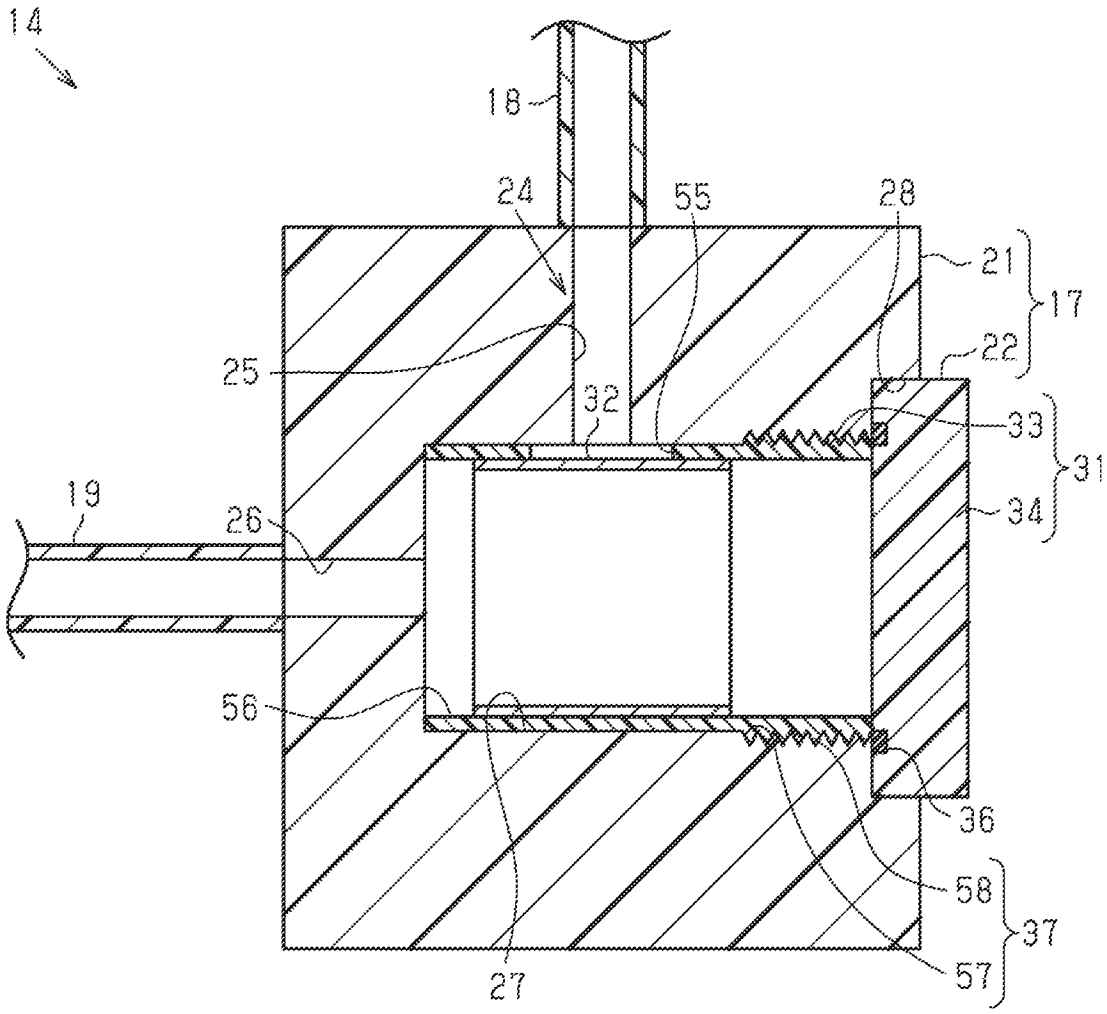
FIG. 10 is a cross-sectional view of the flow path unit in a state where a filter unit is mounted in the flow path unit from a state illustrated in FIG. 9.

The flow path unit 17 may be modified as illustrated in FIG. 9 and FIG. 10. In this modification, the holding portion 33 is formed in a circular cylindrical shape, for example. The handle portion 34 is formed in a disc shape, for example. Accordingly, the opening 28 is formed in a circular shape.

The holding portion 33 has pass-through openings that cause liquid to pass therethrough. In this modification, two pass-through openings are formed, for example, one of the two pass-through openings is an inlet port 55 and the other is an outlet port 56. That is, the holding portion 33 has the inlet port 55 and the outlet port 56 as the pass-through openings. The inlet port 55 is a hole that communicates with the first flow path 25 in a state where the filter unit 22 is mounted in the flow path member 21. Liquid that flows through the first flow path 25 is introduced into the holding portion 33 through the inlet port 55. The outlet port 56 is a hole that communicates with the second flow path 26 in the state where the filter unit 22 is mounted in the flow path member 21. Liquid in the holding portion 33 is led to the outside of the holding portion 33 through the outlet port 56.

The filter 32 is accommodated in the holding portion 33. That is, the filter 32 is positioned in the holding portion 33. The filter 32 is formed in a cylindrical shape, for example, and is positioned so as to be brought into contact with an inner surface of the holding portion 33. With such a configuration, the filter 32 is positioned so as to close the inlet port 55. Accordingly, the filter 32 removes foreign materials when liquid is introduced into the holding portion 33 through the inlet port 55. The filter 32 may be positioned so as to close the outlet port 56.

The filter 32 is removable from the inside of the holding portion 33. Accordingly, in this modification, the filter 32 can be exchanged independently from the holding portion 33 by removing the filter unit 22. The filter 32 is, for example, a cylindrically-wound mesh filter. The filter 32 may be a block-shaped sponge filter.

The stopper 37 includes a first screw thread 57 and a second screw thread 58, for example. The first screw thread 57 is formed on the flow path member 21. The second screw thread 58 is formed on the filter unit 22. Specifically, the second screw thread 58 is formed on the holding member 31. That is, the flow path member 21 has the first screw thread 57, and the holding member 31 has the second screw thread 58. In this modification, the first screw thread 57 is a female screw thread, and the second screw thread 58 is a male screw thread. By making the first screw thread 57 and the second screw thread 58 threadedly engage with each other, the filter unit 22 is mounted in the flow path member 21. According to this modification, the following advantageous effects can be obtained.

(6) By making the first screw thread 57 and the second screw thread 58 threadedly engage with each other, it is possible to suppress the removal of the filter unit 22 mounted in the flow path member 21.

The stopper 37 may be a pawl configured to retain the filter unit 22 mounted in the flow path member 21. The pawl is formed on the flow path member 21, for example.

Liquid ejected by the head 12 is not limited to ink, and may be a liquid body obtained by dispersing or mixing particles made of a functional material in liquid, for example. For example, the head 12 may be configured to eject a liquid body including, in a dispersed manner or dissolved manner, a material such as an electrode material or a pixel material used in manufacture and the like of a liquid crystal display, an electroluminescent display, and a surface emitting display.

Hereinafter, technical concepts and advantageous effects thereof that are understood from the above-described embodiment and modifications are described.

(A) Provided is a flow path unit through which liquid to be supplied to a head configured to eject the liquid flows, wherein the flow path unit includes a flow path member having a flow path, and a filter unit configured to be detachably attached to the flow path member, the flow path member has an opening that communicates with the flow path and to which the filter unit is configured to be mounted, and the filter unit includes a filter configured to filter liquid flowing through the flow path, and a holding member configured to hold the filter.

According to the configuration described above, the filter can be exchanged with a new filter by removing the filter unit from the flow path unit through the opening. That is, in exchanging the filter, the ease of use of the flow path unit is improved compared to a case where the entire flow path unit is exchanged.

(B) The above-described flow path unit may be configured to include an elastic member having elasticity between the flow path member and the filter unit.

According to the configuration described above, a possibility that liquid leaks out from the flow path through the opening can be reduced by the elastic member.

(C) In the flow path unit described above, the elastic member may be configured to be removable from the flow path member.

According to the configuration described above, the elastic member can be exchanged.

(D) In the above-described flow path unit, the elastic member may be fixed to the filter unit.

According to the configuration described above, the elastic member can be exchanged along with the exchange of the filter unit.

(E) The above-described flow path unit may include a stopper configured to retain the filter unit mounted in the flow path member.

According to the configuration described above, it is possible to suppress an unexpected removal of the filter unit from the flow path member.

(F) In the above-described flow path unit, the holding member may include a holding portion configured to accommodate the filter, the holding portion may have a pass-through opening through which liquid passes, the filter may be positioned in the holding portion so as to close the pass-through opening, the flow path member may have a first screw thread, the holding member may have a second screw thread configured to be engaged with the first screw thread, and the stopper may have the first screw thread and the second screw thread.

According to the configuration described above, by making the first screw thread and the second screw thread threadedly engage with each other, it is possible to suppress the removal of the filter unit mounted in the flow path member.

(G) A liquid ejecting device includes a head for ejecting liquid, and a flow path unit through which liquid to be supplied to the head flows, wherein the flow path unit includes a flow path member having a flow path, and a filter unit configured to be detachably attached to the flow path member, the flow path member has an opening that communicates with the flow path and to which the filter unit is configured to be mounted, and the filter unit includes a filter configured to filter liquid flowing through the flow path, and a holding member configured to hold the filter.

According to the configuration described above, advantageous effects substantially equal to those of the above-described flow path unit can be obtained.

What is claimed is:

1. A flow path unit through which liquid to be supplied to a head for ejecting the liquid flows, the flow path unit comprising:

a flow path member having a flow path;

a filter unit configured to be detachably attached to the flow path member; and a stopper configured to retain the filter unit mounted in the flow path member, wherein the flow path member has an opening that communicates with the flow path and to which the filter unit is configured to be mounted, the filter unit includes:

a filter configured to filter liquid flowing through the flow path; and a holding member configured to hold the filter, the holding member includes a holding portion configured to accommodate the filter, the holding portion has a pass-through opening through which liquid passes, the filter is positioned in the holding portion so as to close the pass-through opening, the flow path member has a first screw thread, the holding member has a second screw thread configured to be engaged with the first screw thread, and the stopper has the first screw thread and the second screw thread.

2. The flow path unit according to claim 1, comprising an elastic member having elasticity between the flow path member and the filter unit.

3. The flow path unit according to claim 2, wherein the elastic member is configured to be removable from the flow path member.

4. The flow path unit according to claim 2, wherein the elastic member is fixed to the filter unit.

5. A liquid ejecting device comprising:

a head configured to eject liquid; and a flow path unit through which liquid to be supplied to the head flows, wherein the flow path unit includes:

a flow path member having a flow path;

a filter unit configured to be detachably attached to the flow path member; and a stopper configured to retain the filter unit mounted in the flow path member, the flow path member has an opening that communicates with the flow path and to which the filter unit is configured to be mounted, the filter unit includes:

a filter configured to filter liquid flowing through the flow path; and a holding member configured to hold the filter, the holding member includes a holding portion configured to accommodate the filter, the holding portion has a pass-through opening through which liquid passes, the filter is positioned in the holding portion so as to close the pass-through opening, the flow path member has a first screw thread, the holding member has a second screw thread configured to be engaged with the first screw thread, and the stopper has the first screw thread and the second screw thread.

* * * * *